United States Patent [19]

Wortham

[11] Patent Number: 4,750,636

[45] Date of Patent: Jun. 14, 1988

[54] TEST TUBE OPENING HOOD AND PROCESS

[76] Inventor: Eastol G. Wortham, 14551 Florita Rd., La Mirada, Calif. 90638

[21] Appl. No.: 100,624

[22] Filed: Sep. 24, 1987

[51] Int. Cl.[4] ..... H05B 1/00

[52] U.S. Cl. ..... 220/319; 220/229; 220/287; 220/DIG. 21; 604/110

[58] Field of Search ..... 422/102, 300; 604/110, 604/339, 332, 277; 128/760, 767; 220/319, 229, 287, DIG. 21, 315, 85 F

[56] References Cited

U.S. PATENT DOCUMENTS

| | | | |
|---|---|---|---|
| 1,062,532 | 5/1913 | Blair | 220/319 X |
| 3,796,359 | 3/1974 | Dick | 604/110 X |
| 3,899,100 | 8/1975 | Rigaud | 220/229 |
| 4,573,984 | 3/1986 | Benzies | 604/339 |

FOREIGN PATENT DOCUMENTS

| | | | |
|---|---|---|---|
| 868840 | 7/1953 | Fed. Rep. of Germany | 220/315 |
| 2040268 | 8/1980 | United Kingdom | 220/229 |

*Primary Examiner*—Stephen Marcus
*Assistant Examiner*—Nova Stucker
*Attorney, Agent, or Firm*—Edgar W. Averill, Jr.

[57] ABSTRACT

A disposable hood and container assembly for shielding the stopper and top of a test tube during the opening thereof. A container having a cylindrical top has a plastic bag affixed over the top so that the body of the bag extends above the container. The bag has a reinforced opening in the wall through which the stoppered end of a test tube may be inserted. The stopper is then removed by grasping it from outside of the bag and dropping it into the container. Gross blood, serum, other body fluids or any aerosol of blood or body fluids caused by rushing in of air into the evacuated space is captured within the plastic bag. This reduces contamination of the laboratory environment and augments the use of gloves, masks and goggles.

6 Claims, 1 Drawing Sheet

TEST TUBE OPENING HOOD AND PROCESS

BACKGROUND OF THE DISCLOSURE

The field of the invention is medical and laboratory equipment and the invention relates more particularly to safety equipment for reducing the chance of catching infectious diseases from fluids stored in test tubes. Most commonly, the fluid is human blood or serum and because of the infectious nature of AIDS, hepatitis, and other bloodborne diseases, a means of shielding technicians and the environment from the aerosols which occur upon opening of test tubes and of safely disposing of used test tube stoppers is needed. This problem is particularly acute with the commonly used evacuated blood containers of the type sold under the trademark, "Vacutainer." When the stopper is removed from such containers there is the resultant in-rush of air which can cause an aerosol of the fluid within the container.

Presently, laboratory technicians working with human blood, and other body fluids, are directed to wear masks, goggles and gloves. Such safety precautions, while protecting the technician's hands, eyes and face, do nothing to protect the environment such as counter tops, clothing and other exposed surfaces from contamination by aerosol and by contaminated stoppers. When workers subsequently come in contact with these contaminated surfaces, potential infectious material is spread throughout the laboratory and hospital. Gloves used to open test tubes in the conventional manner will be contaminated by gross fluids and aerosols and will subsequently contaminate the environment unless they are immediately removed and replaced with new ones once they have been used. If they become contaminated during the procedure, the environment will also be contaminated.

SUMMARY OF THE INVENTION

It is an object of the present invention to provide a low-cost, yet safe method for removing the stopper from a stoppered test tube containing potentially infectious or dangerous materials in a manner so that the used test tube stopper and any body fluids or aerosol emanating from the test tube as it is opened are captured in an area inaccessible to the person opening the tube and isolated from the laboratory environment.

The present invention is for a disposable hood and container assembly for shielding the stopper and top of a test tube during the opening thereof. The assembly includes a container having a generally cylindrical open top. A flexible plastic bag, having an opening slightly larger than the cylindrical open top of the container, is sealed over the open top of the container so that the plastic bag extends upwardly from the container. A reinforced opening is formed in the wall of the plastic bag near the middle thereof. The size of the opening is sufficient so that the stoppered end of a test tube may be passed therethrough. The invention also includes the process for using the above-described device. The steps include grasping the middle of a stoppered test tube; placing the stoppered end of the tube through a hole in the side of an inverted plastic bag which has its open end affixed over a container. Next, the stopper is grasped from the outside of the plastic bag and pulled out of the test tube. The stopper is then released and allowed to fall into the container and the open tube is withdrawn from the opening in the bag. After testing is completed, if necessary, a new stopper (cap) should be placed on the tube.

DESCRIPTION 0F THE PREFERRED EMBODIMENTS

Figure 1:
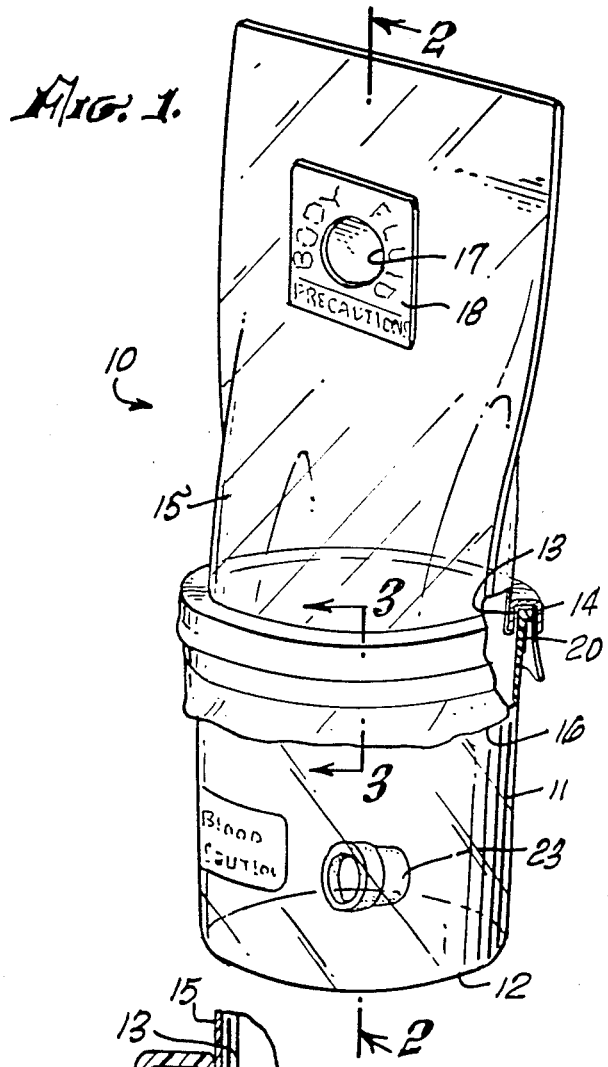
FIG. 1 is a perspective view of the disposable hood and container assembly of the present invention.

A disposable hood and container assembly for shielding the stopper and the top of a test tube during the opening thereof is shown in FIG. 1 and indicated generally by reference character 10. Assembly 10 has a container 11 which has a flat bottom which permits the assembly to be securely placed on a lab table or other flat surface. Container 11 also has a cylindrical opening over which a seal 14 is snapped. Seal 14 captures a plastic bag 15 and holds the bag securely over the opening 13 of container 11. Bag 15 has an opening 16 which must be larger than the cylindrical opening 13 so that it may be placed over opening 13 as shown in FIG. 1.

Bag 15 has a reinforced opening 17 which is larger than the stoppered end of a test tube with which the assembly is used. Opening 17 is reinforced by the adhering of a square, hazard-warning label 18 over the opening 19 in bag 15.

Figure 2:
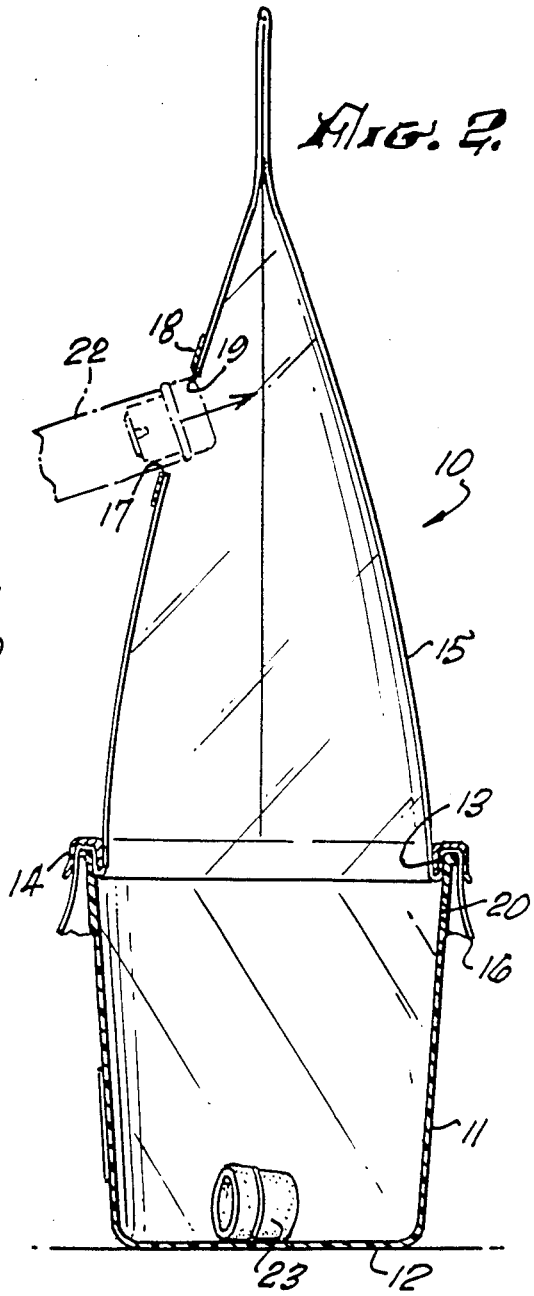
FIG. 2 is an enlarged side view taken along line 2—2 of FIG. 1.
Figure 3:
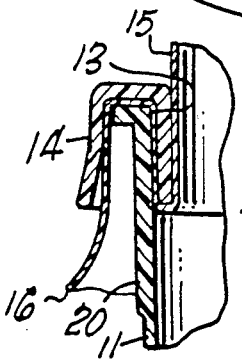
FIG. 3 is an enlarged cross-sectional view taken along line 3—3 of FIG. 1.

The sealing of bag 15 over the opening 13 of container 11 is shown best in FIG. 2 where it can be seen that seal 14 has an inverted, generally U-shaped, cross-sectional shape which fits tightly over the flange 20 at opening 13. Container 11 is preferably transparent so that it may easily show how many stoppers have been placed therein. When the container 11 is about full, the entire assembly may be discarded with the infectious waste material. By using polystyrene containers and polyethylene plastic bags and reinforced polyethylene seals, a very low-cost assembly results.

Figure 4:
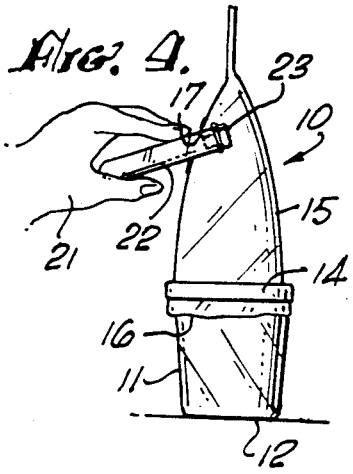
FIG. 4 is a side view showing a stoppered test tube being placed through the opening of the assembly of FIG. 1.
Figure 5:
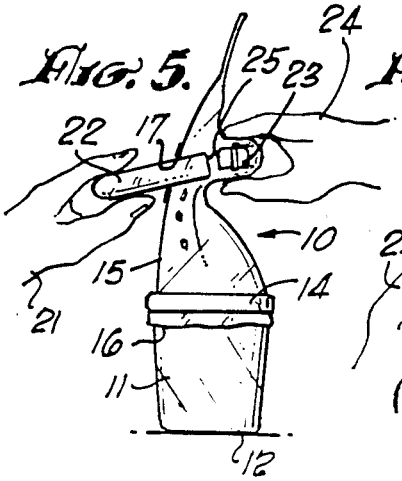
FIG. 5 is a side view showing the stopper being withdrawn from the stoppered test tube.
Figure 6:
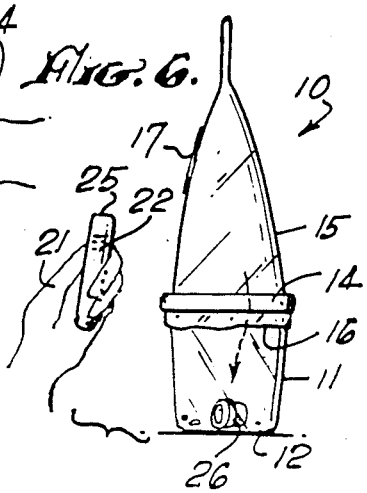
FIG. 6 is a side view showing the unstoppered test tube and the stopper in the bottom of the assembly of FIG. 1.

The process of the use of the present invention is shown best in FIGS. 4, 5 and 6. In FIG. 4, the lab technician's left hand 21 is grasping test tube 22 which contains stopper 23. The open end of the test tube and stopper 23 are placed through reinforced opening 17 in bag 11 so that the stopper 23 is well in the interior of the bag. Next, as shown in FIG. 5, the lab technician's right hand grasps the stopper 23 so that the open end 25 of test tube 22 is well within plastic bag 15. The stopper may then be removed in a conventional manner. The stopper frequently has gross body fluid adhering to it and in the event the test tube contains an evacuated portion, as do most blood containing test tubes, the air will rush into the test tube and often create an aerosol of blood, or other fluid, which is safely contained within the plastic bag 15. Lastly, the stopper is allowed to fall into container 11, as shown in FIG. 6, and the safely opened test tube 22 may be withdrawn from the assembly.

It can be readily seen that the use of the assembly of the present invention substantially reduces the chance of contamination with fluids held within stoppered test tubes. Since the reality in many laboratories is that laboratory technicians are removing stoppers and tossing them through the air into a trash can which results in gross aerosol contamination of themselves and the environment, the use of this device in conjunction with masks, gloves and goggles can substantially reduce the possibility of infection. Although an inverted U-shaped seal 14 is shown in the drawings, other methods may be used to hold the flexible plastic bag over the container. For instance, a rubberband or strip of adhesive tape are examples of other methods for holding such containers. The containers may be nested for storage or shipping but when the top of the bag is pulled upwardly, the bag will stay upright, as shown in the drawings, and it is easy to insert the stoppered end of the test tube through the reinforced opening.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A disposable hood and container assembly for shielding the stopper and top of a test tube during the opening thereof comprising:

a container having a generally cylindrical open top:

a flexible plastic bag having an opening slightly larger than the cylindrical open top of the container, said bag being sealed near its opening over the cylindrical open top; and a reinforced opening in the wall of said flexible plastic bag, said opening being sufficiently large to permit the placing of a stoppered end of a test tube to be opened therethrough.

2. The disposable hood and container assembly of claim 1 wherein said flexible plastic bag is held to said container by a circular sealing ring having an inverted generally U-shaped cross-section frictionally held over the rim at said cylindrical open top.

3. The disposable hood and container assembly of claim 1 wherein said disposable container is transparent.

4. The disposable hood and container assembly of claim 1 wherein said container is formed from polystyrene.

5. The disposable hood and container assembly of claim 1 wherein said reinforced opening is formed by adhering a piece of cardboard around the periphery of said opening.

6. A method for safely opening a test tube containing a fluid and an evacuated space above said fluid comprising:

grasping the middle of a stoppered test tube;

placing the stoppered end of the stoppered test tube through a hole in the side of an inverted plastic bag which has its open end affixed over a container;

grasping the stopper through the side of the plastic bag from the outside of the plastic bag;

pulling the stopper out of the test tube;

releasing the stopper while it is within the bag and allowing the removed stopper to fall into the container: and withdrawing the open end of the opened test tube from the bag.

* * * * *